US009418826B2

(12) United States Patent
Hirano et al.

(10) Patent No.: US 9,418,826 B2
(45) Date of Patent: Aug. 16, 2016

(54) ION OPTICAL SYSTEM FOR MASS SPECTROMETER

(71) Applicant: Agilent Technologies, Inc., Santa Clara, CA (US)

(72) Inventors: Kazushi Hirano, Tokyo (JP); Jun Kitamoto, Tokyo (JP)

(73) Assignee: Agilent Technologies, Inc., Santa Clara, CA (US)

( * ) Notice: Subject to any disclaimer, the term of this patent is extended or adjusted under 35 U.S.C. 154(b) by 0 days.

(21) Appl. No.: 14/571,858

(22) Filed: Dec. 16, 2014

(65) Prior Publication Data

US 2015/0187555 A1 Jul. 2, 2015

(30) Foreign Application Priority Data

Dec. 27, 2013 (JP) ..... 2013-273544

(51) Int. Cl.
*H01J 49/26* (2006.01)
*H01J 49/06* (2006.01)
*H01J 49/42* (2006.01)

(52) U.S. Cl.
CPC ..... *H01J 49/061* (2013.01); *H01J 49/42* (2013.01)

(58) Field of Classification Search
USPC ..... 250/281, 282, 283, 288
See application file for complete search history.

(56) References Cited

U.S. PATENT DOCUMENTS

2007/0029473 A1* 2/2007 Verentchikov ..... H01J 49/406 250/281
2009/0266984 A1* 10/2009 Hirano ..... 250/288

FOREIGN PATENT DOCUMENTS

JP H0778590 A 3/1995
JP 2002525821 A 8/2002
JP 2004515882 A 5/2004

* cited by examiner

*Primary Examiner* — Nicole Ippolito

(57) ABSTRACT

A mass spectrometer includes: a plasma generation device for generating plasma for ionizing an introduced sample; an interface device for drawing the plasma into vacuum; an ion lens device for extracting and inducing ions as an ion beam from the plasma; a collision/reaction cell for removing an interference ion from the ion beam; a mass analyzer or filter for allowing a predetermined ion in the ion beam from the collision/reaction cell to pass along a first axis based on a mass-to-charge ratio; an ion detector for detecting the ion; an ion deflection device before the mass analyzer, and also an ion deflection device between the mass analyzer and the ion detector. The mass spectrometer reduces background noises in a mass analyzer by removing neutral particles from the ion beam without reducing the measurement sensitivity on ions to be analyzed as much as possible.

8 Claims, 7 Drawing Sheets

ION OPTICAL SYSTEM FOR MASS SPECTROMETER

RELATED APPLICATIONS

This application claims the benefit under 35 U.S.C. 119 of Japanese Patent Application No. 2013-273544, filed Dec. 27, 2013, titled "ION OPTICAL SYSTEM FOR PLASMA MASS SPECTROMETER," the content of which is incorporated by reference herein in its entirety.

TECHNICAL FIELD

The present invention relates to a mass spectrometer using plasma as an ion source, particularly to a mass spectrometer with an ion deflector.

BACKGROUND

As an analyzer for analyzing inorganic elements with high precision, a plasma mass spectrometer is known. This instrument introduces an atomized sample to be analyzed into plasma formed over a plasma torch; ionizes elements contained in the sample; extracts ions present in the plasma in the form of an ion beam; and conducts mass spectrum analysis on ions forming the ion beam. As plasma to which a sample is introduced, used is inductively-coupled plasma (ICP) generated using as an energy source a high frequency electromagnetic field provided from a coil adjacent to a plasma torch; or microwave plasma generated by a microwave introduced to a tip of a plasma torch. In general, the former is known as an inductively-coupled plasma mass spectrometer (ICP-MS) and the latter is known as a microwave induced plasma mass spectrometer (MIP-MS).

FIG. 7 is a schematic view showing a basic concept of an exemplary inductively-coupled plasma mass spectrometer (hereinafter, also referred to simply as instrument) 11 according to the conventional art. The instrument 11 has a plasma torch 20 for generating plasma 22, an interface section 30 placed at a position facing the plasma 22, an ion lens section 50 placed behind the interface section 30, an ion guide section 70 placed behind the ion lens section 50, and a mass analysis section 80 placed behind the ion guide section 70. The instrument 11 can generally measure positive ions, but it can also measure negative ions. This specification is described under the assumption that the device 11 measures positive ions. It is evident to those skilled in the art that when the instrument 11 measures negative ions, the polarity of a voltage to be applied to an electrode or the like is inverted.

The plasma torch 20 has a coil 21 for generating a high frequency electromagnetic field near its tip, and is placed under atmospheric pressure. The coil 21 is connected to an RF power source not illustrated. In the plasma torch 20, the high frequency electromagnetic field generated by the coil 21 produces high frequency inductively-coupled plasma 22. In the plasma torch 20, an atomized sample not illustrated is introduced into the plasma 22 from the front of the plasma torch 20. The introduced sample not illustrated is vaporized and decomposed by the action of the plasma 22; and in cases of large majority of elements, they are finally converted into ions. The ionized sample not illustrated is contained in the plasma 22. Further, within the plasma torch 20, a gas flow occurs from the back end to the front end, so the plasma 22 extends towards a sampling cone 31.

The interface section 30 is provided with two cone members, that is the sampling cone 31 and a skimmer cone 33. A part of plasma 32 having passed through an aperture 37 of the sampling cone 31 directly facing the plasma 22 reaches the skimmer cone 33 positioned further behind. Thereafter, a part of plasma 32 passes through an aperture 38 formed in the skimmer cone 33 and reaches the rear thereof. Gas molecules (including neutralized ions) not having passed through the skimmer cone 33 are discharged from the interface section 30 via an exhaust port 39 by a rotary pump RP.

The ion lens section 50 is provided with a first electrode 53 and a second electrode 54 forming an extraction electrode section. The first electrode 53 or the second electrode 54 forming the extraction electrode section is at negative potential, and thus, only positive ions are extracted from the plasma 52 in the form of an ion beam. The ion beam is guided from the second electrode 54 into a collision/reaction cell 71 of the ion guide section 70. However, an ion deflection lens is arranged subsequent to the second electrode 54 and the ion beam may be guided into the collision/reaction cell 71 via the ion deflection lens.

The ion beam guided into the collision/reaction cell 71 is induced to a subsequent stage along a track determined by an electric field generated by a multipole electrode 73. The multipole electrode 73 has, for example, an octapole structure. Further, a collision/reaction gas may be introduced from a feeding port 72 into the collision/reaction cell 71. Molecules of the introduced gas cause reaction associated with collision or charge transfer with various ions contained in the ion beam, thereby removing, from the ion beam, polyatomic ions or interference ions that are composed of elements contained in carrier gas and the sample and cause interferences in mass spectra.

During operation of the instrument 11, the ion guide section 70 is exhausted together with the ion lens section 50 by using a turbo molecular pump (TMP1). Therefore, molecules that have been contained in the plasma but neutralized within the ion lens section 50 or the ion guide section 70, or molecules of collision/reaction gas that are introduced into the collision/reaction cell are exhausted through an exhaust port 79.

An ion beam 75 out of the collision/reaction cell 71 is introduced into the mass analysis section 80. In the mass analysis section 80, there is provided a multipole structure 81 of quadrupole, which is known as a quadrupole mass analyzer or a quadrupole mass filter (hereinafter, the multipole structure 81 is referred to as a mass analyzer). An electric field generated by the mass analyzer allows ions in the ion beam to pass through the mass analyzer 81 along an X-axis in FIG. 7 and to be separated based on a mass-to-charge ratio. Subsequently, separated ions 85 (indicated by a broken line) are guided to a subsequent ion detector 82. The mass analysis section 80 is also exhausted by using a turbo molecular pump (TMP2) in the same manner as the ion guide section 70, and unnecessary ions separated by the mass analyzer 81 and other molecules are exhausted through an exhaust port 84.

The ion detector 82 receives and detects ions separated at the mass analyzer 81 to convert into electric signals. For example, an inductively-coupled plasma mass spectrometer (ICP-MS) is an instrument having a large dynamic range to detect from signals for trace quantities (e.g., 0.1 cps) to signals for main components (e.g., $10^{10}$ cps). In general, when detected signals are low, ion counting is used for measurement; and when detected signals are high, analog measurement is used. For example, in the case of ion counting, ions are introduced into a secondary electron multiplier thereby to be converted to $10^5$ to $10^6$-times amplified electrons. Such electrons are converted into a voltage pulse and counted for a certain period of time and thereby, an ion count is obtained.

In such a mass spectrometer, when ions are extracted from plasma at the first electrode 53 or the second electrode 54, neutral particles with high energy are produced. Such neutral particles are generally known as a cause for background noises, and separation of these neutral particles from ions is required. Mechanisms for conducting such separation are disclosed, for example, in Patent Document 1 (Japanese Patent Laid-Open Publication No. H7-78,590); Patent Document 2 (National Publication of International Patent Application No. 2002-525,821); and Patent Document 3 (National Publication of International Patent Application No. 2004-515,882).

Patent Document 1, for example, discloses that an ion lens has a 90° deflector, whereby neutral particles contained in an ion beam having passed through an interface are prevented from reaching a mass filter. Further, Patent Document 2 discloses that a beam composed of ions and neutral particles coming through an opening of a skimmer cone is reflected at 90° by an ion mirror and sent to a mass analyzer, whereby neutral particles are prevented from reaching the mass analyzer.

Patent Document 3 discloses an ion mirror 42 similar to that of Patent Document 2. In order to increase the transmission of an ion injection port of a mass analysis section, Patent Document 3 also discloses that quadrupole fringe electrodes 56 are provided between the ion mirror 42 and a linear quadrupole mass analyzer 54. Four rod-shaped electrodes of this quadrupole fringe electrode 56 are curved while being kept parallel to each other, and prevent neutral particles from reaching the linear quadrupole mass analyzer 54.

However, when ions are introduced into a mass analyzer (e.g., quadrupole mass analyzer); and these ions are accelerated by an RF voltage of quadrupole electrodes and collided with molecules of residual gas, the ions may be changed to neutral particles having energy before the collision. These neutral particles collide with a wall near within an ion detector thereby to generate secondary ions, which may be detected as background noises by the ion detector. In particular, a plasma mass spectrometer has a larger amount of ions derived from carrier gas than GC-MS or LC-MS. Thus, it is likely to have a drawback on background noises caused by the generation of neutral particles.

Further, when a deflector or an ion mirror is arranged prior to a mass analyzer as disclosed in Patent Documents 1 to 3, a certain amount of ions to be measured is lost and the measurement sensitivity may be deteriorated. This is because a difference of deflection angle occurs due to the energy difference depending on the mass number of an ion; or a difference in the output position of an ion due to the incident position or the incident angle of the ion to a deflector. In addition, curved quadrupole fringe electrodes disclosed in Patent Document 3 may have a reduced ion transmission in comparison with a simple straight fringe electrode. Curving four rod-shaped electrodes while keeping them parallel to each other would result in a complicated structure and increase the cost and labor for processing.

SUMMARY

To address the foregoing problems, in whole or in part, and/or other problems that may have been observed by persons skilled in the art, the present disclosure provides methods, processes, systems, apparatus, instruments, and/or devices, as described by way of example in implementations set forth below.

Accordingly, an object of the present invention is to provide: a plasma mass spectrometer, which reduces background noises by removing neutral particles from an ion beam without deteriorating the measurement sensitivity for ions to be measured as much as possible; and an ion deflector, which has a simple an inexpensive structure as means for removing neutral particles from an ion beam.

In order to achieve the above object, the present invention has a first ion deflector for removing neutral particles provided between a plasma ion source and a mass analyzer, and a second ion deflector provided between the mass analyzer and an ion detector, thereby deflecting an ion having passed through the mass analyzer by an electric field and enabling the ion to enter the ion detector. This prevents neutral particles and the like generated before introduction into the mass analyzer from being introduced into the mass analyzer; and removes neutral particles and the like contained in ions that have been generated mainly by the mass analyzer and have passed through the mass analyzer, consequently reducing background noises.

According to one embodiment of the present invention, disclosed is a mass spectrometer having a plasma generation device for generating plasma for ionizing an introduced sample; an interface device for drawing the plasma into vacuum; an ion lens device for extracting and inducing ions as an ion beam from the plasma; a collision/reaction cell for removing an interference ion from the ion beam; a mass analyzer for allowing a predetermined ion in the ion beam from the collision/reaction cell to pass along a first axis based on a mass-to-charge ratio; and an ion detector for detecting the ion. The mass spectrometer includes: at least one first ion deflection device disposed between the ion lens device and the mass analyzer to deflect ions and remove neutral particles or the like from the ion beam; and at least one second ion deflection device disposed between the mass analyzer and the ion detector to deflect ions, wherein the second ion deflection device has an electrode for generating an electric field, which enables a predetermined ion having passed through the mass analyzer along a first axis to be deflected and induced to the ion detector along a second axis.

Further, the second ion deflection device may include, for example, a first shield with a first aperture allowing ions from the mass analyzer to pass and a second shield with a second aperture through the ion detector. The electrode may be arranged so as not to intersect with the first axis; and this signifies that, assuming that a neutral particle passes through the first aperture along the first axis and travels straight, the electrode is arranged so that the neutral particle does not collide with the electrode. In addition, a plurality of electrodes may be arranged so as to deflect ions passing through the first aperture while focusing the ions to the second aperture. Further, in such a case, the number of electrodes may be two, three, four or the like. However, when three electrodes are used, first and second electrodes are arranged so as to face each other across the first axis and the third electrode is arranged so as to face the first electrode across the second axis. The electrodes may be in the form of a rod. Further, the first and second axes may be at right angles to each other, and the angles may be other than the right angle. The first shield may be coupled to the second shield.

Advantages of the Invention

The present invention has: at least one first ion deflection device arranged between the ion lens device and the mass analyzer, and at least one second ion deflection device arranged between the mass analyzer and the ion detector. This can prevent neutral particles and the like generated before mass separation of ions from being introduced into the mass analyzer and remove neutral particles and the like having passed through the mass analyzer generated mainly at the mass analyzer. Neutral particles having enough energy to generate secondary ions, which are detectable by the ion detector and background noises can be reduced. Further, the second ion deflection device can be formed with single or a plurality of rod-shaped electrodes as a main constituent element, and thus the structure thereof is simple and inexpensive.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1:
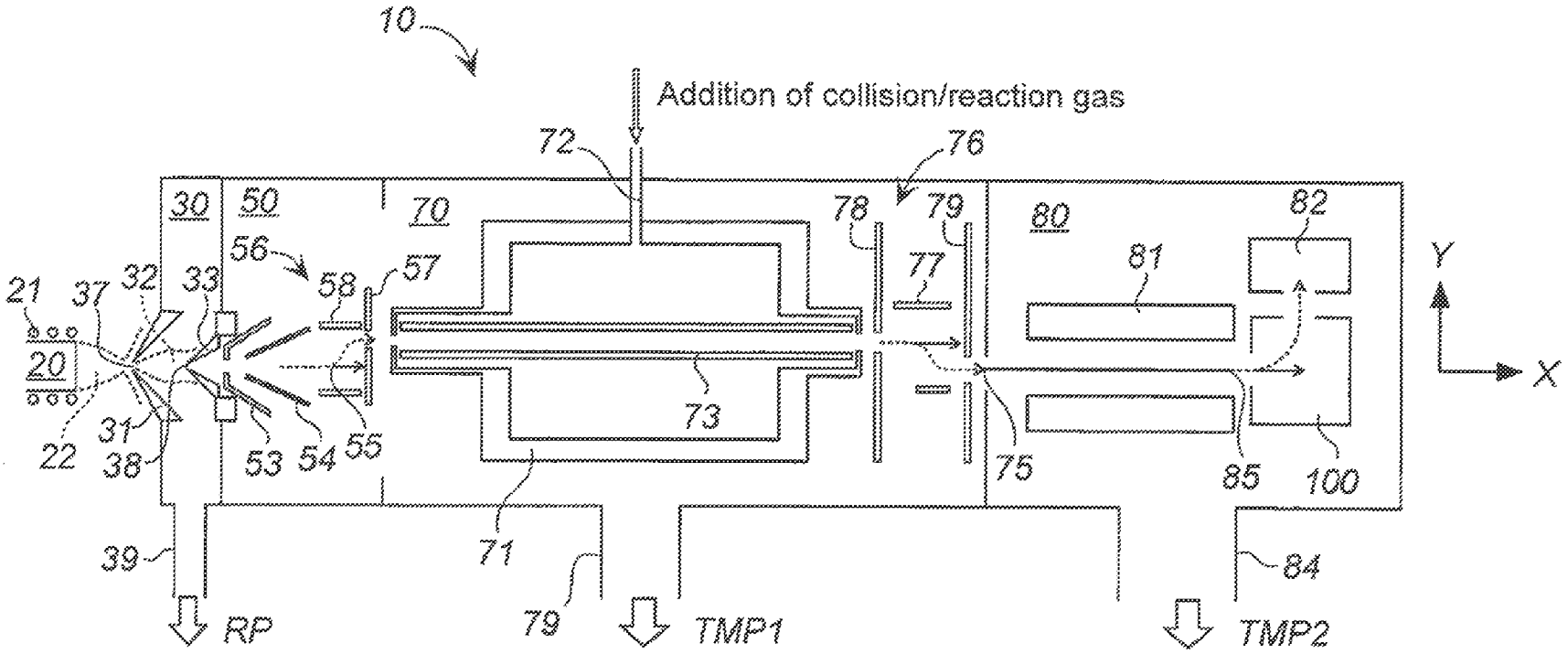
FIG. 1 is a schematic view showing an embodiment of an inductively-coupled plasma mass spectrometer according to the present invention.
Figure 7:
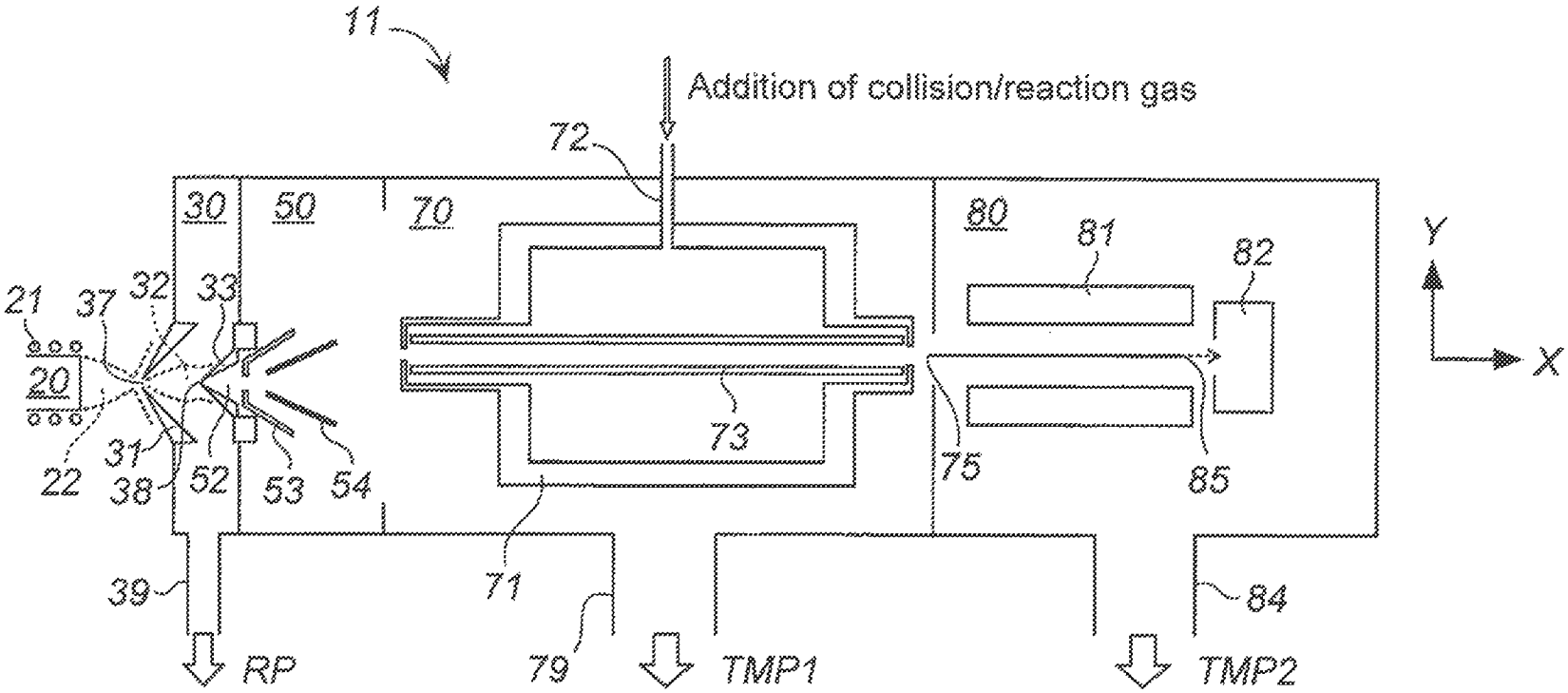
FIG. 7 PRIOR ART
FIG. 7 is a schematic view showing a basic concept of a conventional inductively-coupled plasma mass spectrometer.

Embodiments of the present invention are hereinafter explained by referring to the accompanying drawings. FIG. 1 is a schematic view showing a basic concept of an exemplary inductively-coupled plasma mass spectrometer (hereinafter, referred to simply as "instrument") 10 of the present invention. The same constituent elements as in above-mentioned FIG. 7 are denoted by the same reference numerals to omit explanations on the same constituent elements as in FIG. 7. The instrument 10 of the present invention differs from the conventional instrument 11 explained by the basic concept drawing in that the instrument 10 of the present invention has first and second ion deflection devices. As examples of the first ion deflection device, the instrument 10 of the present invention has an ion deflector 56 located at an ion lens section 50 and an ion deflector 76 located between a collision/reaction cell 71 and a quadrupole mass analysis section 80. Further, the instrument 10 of the present application also has, as an example of the second ion deflection device, an ion deflector 100 between a mass analyzer 81 and an ion detector 82.

The ion deflector 56 is located at a latter part of the ion lens section 50 to deflect an ion beam 55 extracted by an extraction electrode section so that a traveling axis is shifted parallel, thereby introducing ions into a collision/reaction cell 71 while removing neutral particles and the like flown from plasma or generated at the extraction electrode section. For example, the ion deflector 56 is composed of, as shown in FIG. 1, a cylindrical electrode 58 and a shield 57 with an aperture for allowing ions to pass through it. About −150 V of negative voltage, about +10 V of voltage, and about −100 V of negative voltage are applied to a second electrode 54, the cylindrical electrode 58 and the shield 57, respectively. The cylindrical electrode 58 is arranged so as to have its center axis displaced from an entry axis of the ion beam 55, so the ion beam 55 is deflected by the potential of the inner face of the cylindrical electrode 58 to be close to an opposite side of the cylindrical electrode 58. The ion beam 55 is again deflected to pass through the aperture of the shield 57.

The ion deflector 76 is located between the collision/reaction cell 71 and the mass analyzer 81 to deflect an ion beam 75 having passed through the collision/reaction cell 71 so that a traveling axis is shifted parallel, thereby introducing ions into the mass analyzer 81 while removing neutral particles and the like generated at the ion lens section 50 or the collision/reaction cell 71. For example, the ion deflector 76 is composed of, as shown in FIG. 1, a cylindrical electrode 77 having a part of the cylinder cut out, and shields 78, 79 arranged before and after the cylindrical electrode 77 and each having an aperture for allowing ions to pass through it. About −50 V of negative voltage is applied to both of the shields 78, 79 and about +10 V of voltage is applied to the cylindrical electrode 77. A part of the cylindrical electrode 77 at an ion entry side is cut out, so the ion beam 75 is deflected by the potential of the inner face of the cylindrical electrode 77 to be close to an opposite side. The ion beam 75 is again deflected to pass through the aperture of the shield 79.

The ion deflector 100 is located between the mass analyzer 81 and the ion detector 82. The ion deflector 100 is configured to receive ions passing through the mass analyzer 81 (e.g., quadrupole mass analyzer) along the X-axis and deflect ions along the Y-axis to the ion detector 82. That is, ions pass through the mass analyzer 81 along the X axis; are subjected to 90°-deflection by the ion deflector 100; and travel along the Y-axis to the ion detector 82. The X- and Y-axes signify a Cartesian coordinate system. Details of such ion deflector 100 are illustrated in FIG. 2.

Figure 2:
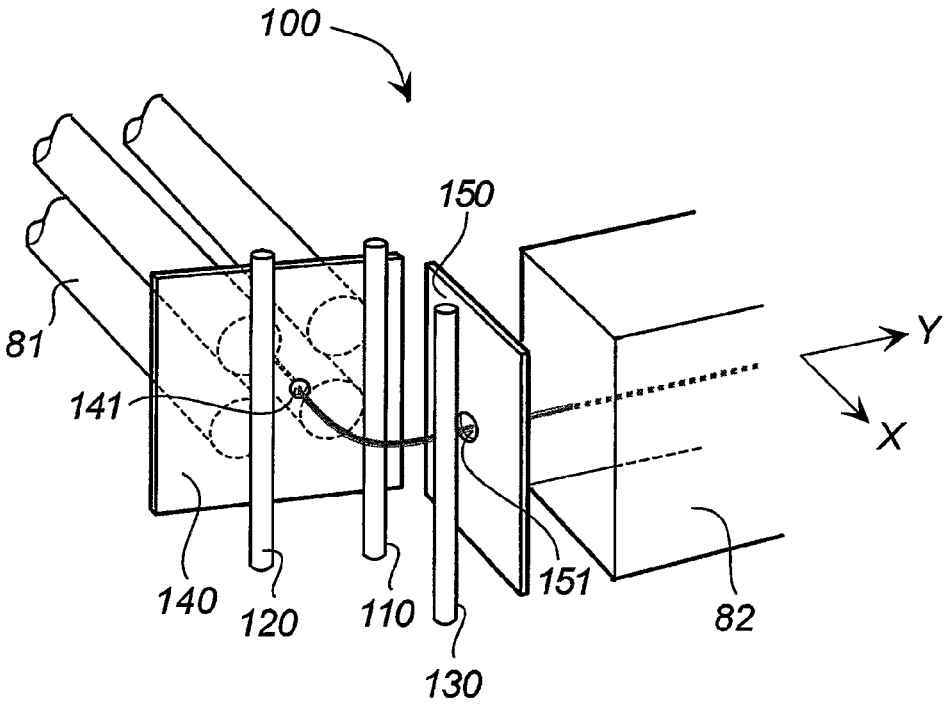
FIG. 2 is a perspective view of a second ion deflector according to the present invention.
Figure 3:
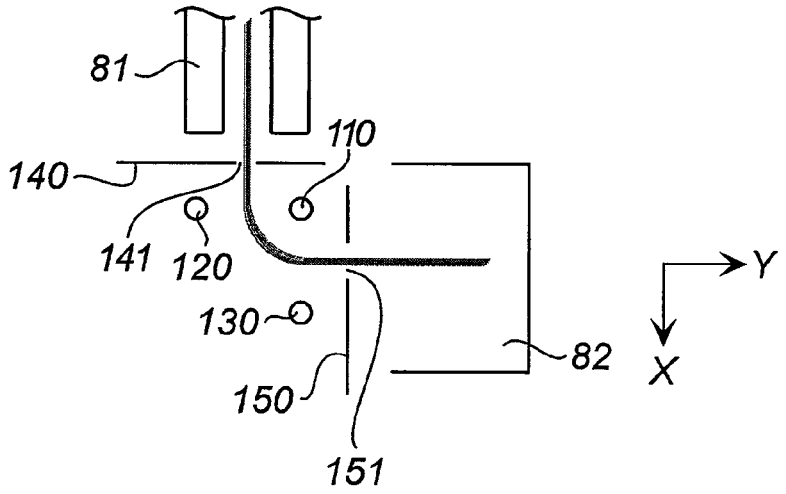
FIG. 3 is a top view of the second ion deflector according to the present invention.

FIG. 2 is a perspective view of the ion deflector 100, and FIG. 3 is a top view of the ion deflector 100. In FIGS. 2 and 3, the ion deflector 100 includes a first shield 140, a second shield 150, a first rod-shaped electrode 110, a second rod-shaped electrode 120 and a third rod-shaped electrode 130. The first shield 140 is arranged adjacent to the mass analyzer 81 and is orthogonal to the X-axis. Further, the first shield 140 includes an aperture 141 for allowing ions having passed through the mass analyzer 81 along the X-axis. The aperture 141 has a diameter of, for example, about 5 mm. The first rod-shaped electrode 110 and the second rod-shaped electrode 120 are arranged opposite to the mass analyzer 81 across the first shield 140 and are spaced from the first shield 140. Then, the first and second rod-shaped electrodes 110 and 120 are arranged to face each other across the X-axis passing through the aperture 141. Therefore, ions passing through the aperture 141 along the X-axis pass between the first and second rod-shaped electrodes 110 and 120. The distance between the first shield 140 and the first or second rod-shaped electrode 110 or 120 is, for example, about 10 mm; and the distance between the first and second rod-shaped electrodes 110 and 120 is, for example, about 20 mm.

The second shield 150 is orthogonal to the first shield 140 and is arranged adjacent to the ion detector 82. The second shield 150 includes an aperture 151 leading to the ion detector 82. This aperture 151 has a diameter of, for example, about 10 mm. The second shield 150 may be connected or disconnected to the first shield 140. The first rod-shaped electrode 110 and the third rod-shaped electrode 130 are arranged opposite to the ion detector 82 across the second shield 150, and are spaced from the second shield 150. The first rod-shaped electrode 110 and the third rod-shaped electrode 130 are arranged to face each other across the axis parallel to the Y-axis passing through the aperture 151. The distance between the second shield 150 and the first rod-shaped electrode 110 or the third rod-shaped electrode 130 is, for example, about 10 mm, and the distance between the first and third rod-shaped electrodes 110 and 130 is, for example, about 20 mm.

About −300 V of voltage, for example, is applied to the first rod-shaped electrode 110, and about 0 V of voltage, for example, is applied to each of the second and third rod-shaped electrodes 120 and 130. Voltages applied to the second and third rod-shaped electrodes 120 and 130 may be the same. Further, about 0 V of voltage, for example, is applied to the first and second shields 140 and 150. Application of a voltage to each electrode or each shield generates an electric field within the ion deflector 100. This electric field deflects ions having passed through the aperture 141 at 90° so that the ions enter into the aperture 151 and also works to focus the ions to the aperture 151. Therefore, ions having passed through the mass analyzer 81 along the X-axis are deflected at 90° by the ion deflector 100 and led to the ion detector 82 along the Y-axis. Such flow of ions is shown schematically by lines in FIGS. 2 and 3.

Each of the first, second and third rod-shaped electrodes 110, 120 and 130 preferably has a circular cross-sectional shape, but may have other shapes such as oval shape, semi-circular shape, triangular shape or rectangular shape. In the case that a rod-shaped electrode has a circular cross-sectional shape, the diameter is about 1 mm to 30 mm. The first, second and third rod-shaped electrodes 110, 120 and 130 can be made of, for example, stainless steel. Further, the first and second shields 140 and 150 can be made of, for example, stainless steel.

Figure 4:
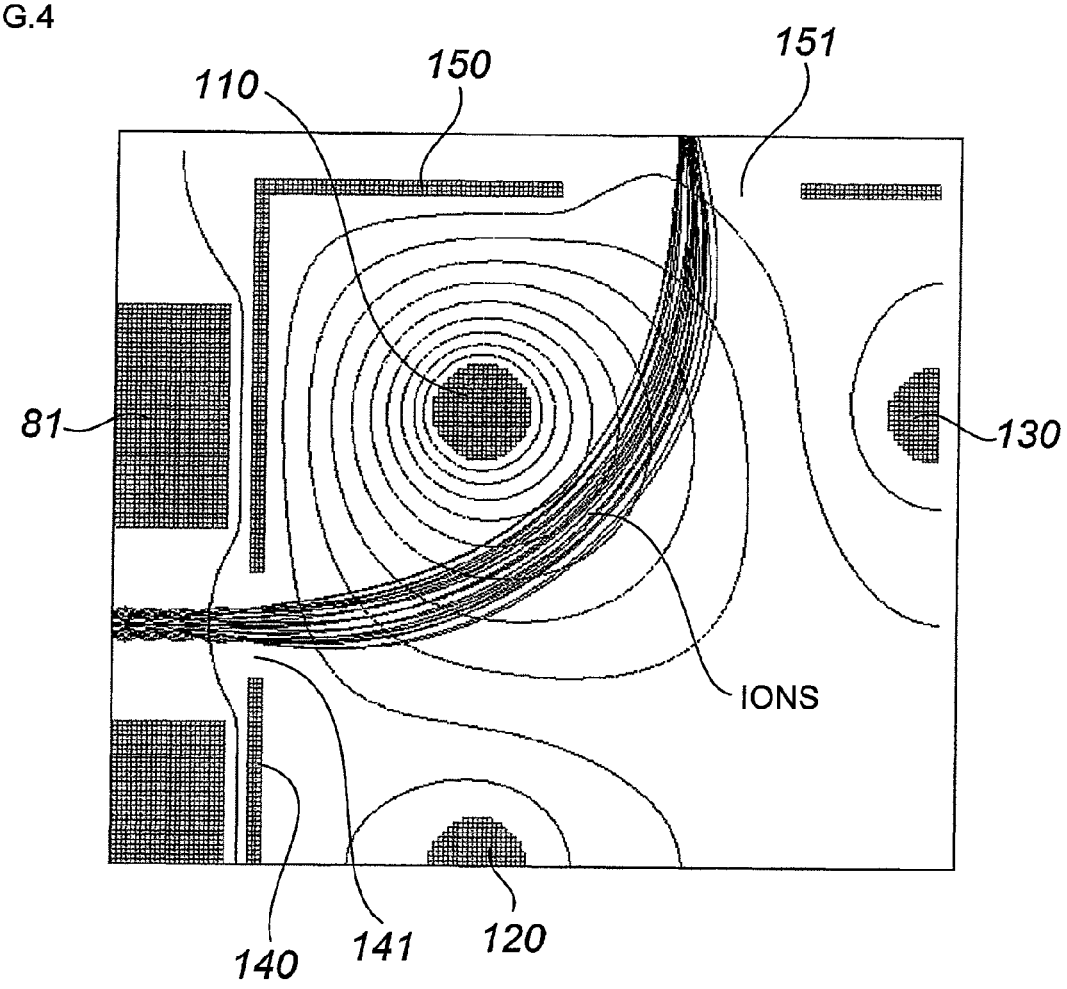
FIG. 4 is a view showing a simulation result of the second ion deflector according to the present invention.

FIG. 4 shows an exemplary simulation result of the ion deflector 100 of the present invention. Conditions for this simulation are that −400 V was applied to the first rod-shaped electrode 110; +20 V was applied to the second and third rod-shaped electrodes 120 and 130; −30 V was applied to the first and second shields 140 and 150; and the energy of ions was +5 eV. As is evident from FIG. 4, ions having passed through the aperture 141 are deflected at 90° to enter the aperture 151 and also are focused to the aperture 151.

The mass analyzer 81 emits a mass-separated ion beam together with neutral particles, which are a cause for background noises. However, when the neutral particles enter the ion deflector 100 of the present invention, they are not subjected to an electrostatic force and thus, they travel straight without 90°-deflection. That is, neutral particles or at least neutral particles having enough energy to generate secondary ions detectable by the detector are not allowed to go to the ion detector 82. Consequently, background noises are reduced. Further, neutral particles having passed through the aperture 141 along the X-axis travel straight as described above, but collision of these neutral particles with, for example, a rod-shaped electrode or the like generates secondary ions, which are a cause for background noises. Therefore, a rod-shaped electrode has to be arranged at such a position that such straight-traveling neutral particles do not collide.

TABLE 1 described below shows measured data on background noises obtained by using an ICP mass spectrometer 7700x manufactured by Agilent Technologies, Inc. as an experimental apparatus for cases: where the ion deflector 100 of the present invention was not used after mass separation (the instrument having a construction where the ion detector 82 was placed at the position for the ion deflector 100 in FIG. 7) and where the ion deflector 100 was incorporated and used after mass separation (the instrument of FIG. 1). This measurement used plasma with a Low Matrix condition, and was conducted in a state where collision/reaction gas was not introduced in the collision/reaction cell.

TABLE 1

| Mass number (u) | 7 | 89 | 205 |
|---|---|---|---|
| Background noise when not used (CPS) | 0.25 | 0.8 | 3.45 |
| Background noise when used (CPS) | 0.1 | 0.1 | 1.2 |
| Ratio of background noises | 0.4 | 0.13 | 0.35 |

As is evident from TABLE 1, use of the ion deflector 100 of the present invention after mass separation reduces respective background noises for mass numbers 7*u*, 89*u* and 205*u* compared to the case where the ion deflector 100 is not used. Background noises for mass numbers 7*u*, 89*u* and 205*u* were reduced by 40%, 13% and 35%, respectively, and a significant improvement was observed.

Figure 5:
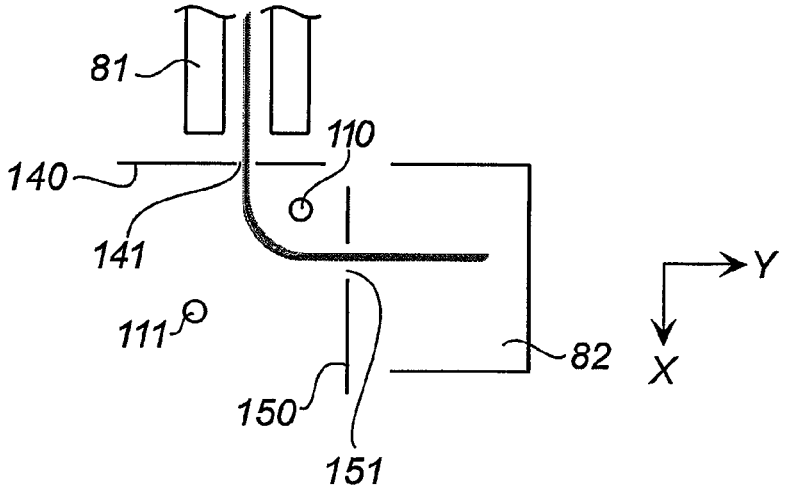
FIG. 5 is a top view of an alternative second ion deflector according to the present invention.
Figure 6:
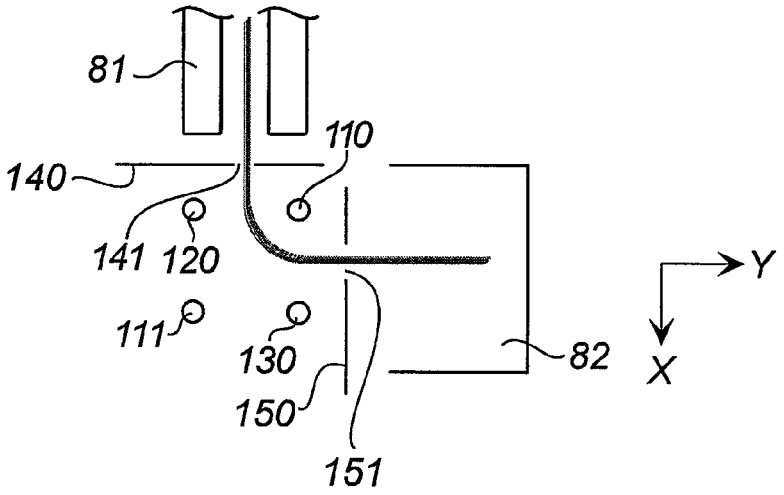
FIG. 6 is a top view of another alternative second ion deflector according to the present invention.

Hitherto, the ion deflector 100 of the present invention is explained so as to deflect incoming ions at 90° and output them (that is, the first shield 140 is orthogonal to the second shield 150). However, the angle for ion deflection, in other words the angle between the first and second shields 140 and 150, is not necessarily 90°, and the angle between the first and second shields 140 and 150 may be, for example in the range of about 30° to about 180°. Further, the ion deflector 100 is explained so as to have three rod-shaped electrodes for ion deflection, but the number of electrodes is not necessarily three and it may be one, two, or four or more. For example, FIG. 5 shows an ion deflector having two rod-shaped electrodes 110 and 111, and FIG. 6 shows an ion deflector having four rod-shaped electrodes 110, 111, 120 and 130. In FIGS. 5 and 6, flow of ions is shown schematically by lines. The position of the rod-shaped electrode 111, for example, may be an intersection of: a line extended from the third rod-shaped electrode 130 in parallel with the first shield 140; and a line extended from the rod-shaped electrode 120 in parallel with the second shield 150. In the ion deflector of FIG. 5, for example, −300 V may be applied to the first rod-shaped electrode 110 and 0 V may be applied to the rod-shaped electrode 111. In the ion deflector of FIG. 6, −300 V may be applied to the first rod-shaped electrode 110, and 0 V may be applied to the second and third rod-shaped electrodes 120, 130 and the rod-shaped electrode 111. However, when two or four rod-shaped electrodes are used, it is significant to arrange rod-shaped electrodes at such positions that neutral particles traveling straight after passed through the aperture 141 along the X-axis do not collide with the rod-shaped electrodes. In the case that the ion deflector 100 has only one rod-shaped electrode (e.g., 110), the energy of ions is changed when the mass spectrometer 10 is operated in a collision gas mode (a mode for introducing collision gas into a collision/reaction cell), and therefore, it has been found that the function of the ion deflector 100 is not sufficient.

DESCRIPTION OF REFERENCE NUMERALS

10 Mass spectrometer
20 Plasma torch

22 Plasma
30 Interface section
50 Ion lens section
56, 76 Ion deflector
71 Collision/reaction cell
81 Mass analyzer
82 Ion detector
100 Ion deflector
110, 111, 120, 130 Electrode
140, 150 Shield
141, 151 Aperture It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. A mass spectrometer, comprising:
a plasma generation device for generating plasma for ionizing an introduced sample;
an interface device for drawing the plasma into vacuum;
an ion lens device for extracting and inducing ions as an ion beam from the plasma;
a mass analyzer for allowing a predetermined ion in the ion beam to pass along a first axis based on a mass-to-charge ratio;
an ion detector for detecting the ion;
at least one first ion deflection device disposed prior to the mass analyzer to conduct ion deflection; and
at least one second ion deflection device disposed between the mass analyzer and the ion detector and configured to generate an electric field to deflect and induce the predetermined ion having passed the mass analyzer along the first axis so as to be along a second axis to the ion detector,
wherein the at least one second ion deflection device comprises a first electrode positioned to deflect the ion beam toward the second axis in response to application of a voltage to the first electrode, and at least one additional electrode positioned on a side of the ion beam opposite to the first electrode.

2. The mass spectrometer according to claim 1, wherein the at least one additional electrode is selected from the group consisting of:
an additional electrode disposed such that the first electrode and the additional electrode face each other along a direction oriented at an angle to the first axis and to the second axis;
a second and a third electrode, wherein the first electrode and the second electrode are disposed so as to face each other across the first axis, and the first electrode and the third electrode are disposed so as to face each other across the second axis; and
both of the foregoing.

3. The mass spectrometer according to claim 1, wherein the first electrode and the at least one additional electrode are rod-shaped.

4. The mass spectrometer according to claim 1, wherein the at least one second ion deflection device comprises a first shield with a first aperture surrounding the first axis, and a second shield with a second aperture surrounding the second axis.

5. The mass spectrometer according to claim 1, comprising a collision/reaction cell between the ion lens device and the mass analyzer.

6. A mass spectrometer, comprising:
a plasma generation device for generating plasma for ionizing an introduced sample;
an interface device for drawing the plasma into vacuum;
an ion lens device for extracting and inducing ions as an ion beam from the plasma;
a collision/reaction cell for removing an interference ion from the ion beam;
a mass analyzer for allowing a predetermined ion in the ion beam from the collision/reaction cell to pass along a first axis based on a mass-to-charge ratio;
an ion detector for detecting the ion;
at least one first ion deflection device disposed prior to the mass analyzer to conduct ion deflection, wherein the at least one first ion deflection device receives an ion beam along an entry axis, and is configured to shift the ion beam to a traveling axis parallel to the entry axis; and
at least one second ion deflection device disposed between the mass analyzer and the ion detector to conduct ion deflection.

7. The mass spectrometer of claim 6, wherein the at least one first ion deflection device has a configuration selected from the group consisting of:
the at least one first ion deflection device comprises a cylindrical electrode;
the at least one first ion deflection device comprises a cylindrical electrode and a shield having an aperture displaced from the entry axis;
the at least one first ion deflection device comprises a first cylindrical electrode upstream of the collision/reaction cell, and a second cylindrical electrode between the collision/reaction cell and the mass analyzer; and
a combination of two or more of the foregoing.

8. A mass spectrometer, comprising:
a plasma generation device for generating plasma for ionizing an introduced sample;
an interface device for drawing the plasma into vacuum;
an ion lens device for extracting and inducing ions as an ion beam from the plasma;
a collision/reaction cell for removing an interference ion from the ion beam;
a mass analyzer for allowing a predetermined ion in the ion beam from the collision/reaction cell to pass along a first axis based on a mass-to-charge ratio;
an ion detector for detecting the ion;
at least one first ion deflection device disposed prior to the mass analyzer to conduct ion deflection; and
at least one second ion deflection device disposed between the mass analyzer and the ion detector to conduct ion deflection, wherein the at least one second ion deflection device receives an ion beam along an entry axis, and is configured to shift the ion beam to a traveling axis parallel to the entry axis.

* * * * *